US005709235A

United States Patent [19]

Akanuma et al.

[11] Patent Number: 5,709,235

[45] Date of Patent: Jan. 20, 1998

[54] RUNNING WATER TYPE WASHING MACHINE

[75] Inventors: Shigeo Akanuma; Yoshinobu Terui, both of Ayase, Japan

[73] Assignee: Speedfam Clean System Co., Ltd., Ayase, Japan

[21] Appl. No.: 714,356

[22] Filed: Sep. 16, 1996

[30] Foreign Application Priority Data

Feb. 2, 1996 [JP] Japan ..... 8-040580

[51] Int. Cl.[6] ..... B08B 3/12

[52] U.S. Cl. ..... 134/111; 134/147; 134/154; 134/182; 134/186; 134/902

[58] Field of Search ..... 134/111, 147, 134/154, 182, 183, 186, 902

[56] References Cited

U.S. PATENT DOCUMENTS 2,713,347 7/1955 Hazy ..... 134/186 X 4,135,530 1/1979 Cheney ..... 134/182 X 4,955,402 9/1990 Miranda ..... 134/902 X

FOREIGN PATENT DOCUMENTS 61-130389 8/1986 Japan .

64-63086 3/1989 Japan .

*Primary Examiner*—Philip R. Coe

*Attorney, Agent, or Firm*—Oblon, Spivak, McClelland, Maier & Neustadt, P.C.

[57] ABSTRACT

Liquid feed section 2 and liquid discharge section 4 of a washing vessel 1 are formed in widths W2 and W4 which are broader than an intermediate washing section 3 with a width W3, and at the same time formed in a greater depth to have bottom surfaces sunken or stepped down from the bottom surface of the washing section 3. Regulator plate holder frames 14 and 20 of upstream and downstream flow regulator means 7 and 8 are located in position by abutting engagement with stepped portions 15 and 21 in such a way that only perforated portions of regulator plates 11, 12, 18 and 19 are disposed in the flow passage to and from the intermediate washing section, precluding flow disturbances which would otherwise be caused by the holder frame or unperforated peripheral portions of the regulator plates.

14 Claims, 4 Drawing Sheets

RUNNING WATER TYPE WASHING MACHINE

BACKGROUND OF THE INVENTION

1. Field of the Art

This invention relates to a running water type washing machine suitable for precision wash of work which requires a high degree of cleanliness like semiconductor wafers, magnetic disk substrates or other electronic parts, optical parts, precision mechanical parts etc.

2. Prior Art

Various running water type washing machines, which are designed to wash work in a submerged state under uniform streams of a wash liquid, have thus far been known in the art, for example, from Laid-Open Japanese Utility Model Specification S61-130389 and also from Laid-Open Japanese Patent Specification S64-63086.

In a washing machine of this sort, for the purpose of preventing detached contaminant substances from being entrained on turbulent wash liquid flows and brought back to re-deposit on work, it has been the general practice to provide a porous flow regulator plate across a channel-like flow passage of a wash liquid, passing the wash liquid therethrough to regulate same into turbulence-free uniform streams (a laminar flow).

In mounting a flow regulator plate across a flow passage of a washing machine, the conventional practice has been to fix the flow regulator plate in position by way of a socket or holder structure in the form of grooves or parallel ridges provided on inner wall surfaces of the flow passage to receive and hold end portions of the regulator plate securely therein with or without use of set screws. However, more often than not, the provision of such a socket or holder structure causes disturbances to the flow of the wash liquid, making it difficult to maintain uniform streams of the wash liquid.

Besides, the regulator flow plate is normally in the form of a metal plate containing a multitude of perforations for water passage, except for blank end portions which are unperforated over a predetermined width from the edges to be fitted in a socket or holder structure on the part of a washing vessel. These unperforated blank portions also tend to arouse disturbances in the wash liquid by impeding its smooth flow.

Therefore, it is an imperative requisite for a flow regulator plate to be mounted in position within a washing vessel through a regulator plate holder structure which would not disturb the flow of a wash liquid.

SUMMARY OF THE INVENTION

It is a primary object of the present invention to provide a running water type washing machine which is arranged to get rid of disturbed flows of a wash liquid, which are attributable to the construction of a washing vessel or of a flow regulator plate holder or socket structure, permitting to maintain uniform streams of a wash liquid in an assured manner.

It is another object of the present invention to provide a running water type washing machine of a construction which can facilitate replacements and cleaning of a flow regulator plate or paltes for easy maintenance and service.

It is still another object of the invention to provide a running water type washing machine employing a washing vessel which is less susceptible to re-deposition of contaminant substances once detached from work.

It is a further object of the invention to provide a running water type washing machine which is capable of adjusting the flow velocity of a wash liquid by the use of a simple means.

It is a still further object of the invention to provide a running water type washing machine which can produce high economical effects by recirculating used wash liquid through a recycling circuit.

In accordance with the present invention, for achieving the above-stated objectives, there is provided a running water type washing machine with a washing vessel defining for a wash liquid a flow passage having in series a liquid feed section for supplying the wash liquid, an intermediate washing section for washing work in a submerged state under streams of the wash liquid from the liquid feed section, and a liquid discharge section for discharging used wash liquid from the washing section, at least either one of the liquid feed and discharge sections being formed in a greater width than the intermediate washing section in the transverse direction thereof and at the same time formed in a greater depth to have a bottom level sunken from that of the washing section through a stepped portion.

In this instance, as an upstream flow regulator means, preferably at least one porous or perforated flow regulator plate is mounted in the liquid feed section with unperforated end portions in abutting engagement with the stepped portion bordering on the intermediate washing section, so that only perforated portions of the flow regulator plate are disposed in the flow passage to the washing section.

These arrangements precludes the possibilities of a wash liquid flow being disturbed by the existence of a regulator plate holder structure which projects inward of the flow passage or by unperforated end portions of the flow regulator plate. Consequently, the washing vessel can maintain a uniform laminar flow of the wash liquid throughout the flow passage in an assured manner.

According to a more specific preferred form of the present invention, similarly to the liquid feed section, the liquid discharge section of the washing vessel is formed in a greater width than the intermediate washing section in the transverse direction thereof, and at the same time formed in a greater depth to have a bottom level sunken from that of the washing section through a stepped portion, and provided with, as a downstream flow regulator means, a porous or perforated flow regulator plate which is mounted in the liquid discharge section with unperforated end portions in abutting engagement with the stepped bottom portion bordering on the intermediate washing section, so that only perforated portions of the flow regulator plate are disposed in the flow passage from the washing section.

Further, in another preferred form of the invention, at least the washing section of the washing vessel is constituted by a single integral structure of plastic molding defining a seamless flow passage for the wash liquid, thereby providing a flow passage free of seams or similar structural parts which would tend to give rise to disturbed flows in the wash liquid or to re-deposition of contaminant substances once detached from work.

According to another specific form of the present invention, the upstream flow regulator means on the side of liquid feed section is in the form of a flow regulator module unit having a plural number of flow regulator plates detachably fitted in a holder frame in predetermined spaced relations with each other, the flow regulator unit being replaceably fitted in and across the flow passage of the liquid feed section in engagement with the above-mentioned stepped portion.

The use of the flow regulator unit makes the maintenance and service extremely easy because the flow regulator plates can be replaced or cleaned in a considerably facilitated manner.

According to the present invention, preferably the downstream flow regulator means on the side of the liquid discharge section of the washing vessel is provided with a couple of porous or perforated flow regulator plates which are mounted in position in a relatively displaceably overlapped state, so that one regulator plate can be adjusted into and out of the flow passage to vary water passing open areas of the flow regulator means, thereby permitting easy adjustments of flow velocity of the wash liquid whenever necessary.

According to another specific form of the invention, the washing vessel is provided with a work transfer means for transferring work from a downstream end to an upstream end of the washing section in a counter-flow direction and in a submerged state under streams of the wash liquid.

Preferably, the washing vessel of the invention further includes a wash liquid recycling circuit for recirculating used wash liquid from the liquid discharge section to the liquid feed section of the vessel.

According to the invention, if desired, an ultrasonic radiation means may be provided in the washing section for enhancing washing effects by application of ultrasound energy.

The above and other objects, features and advantages of the invention will become apparent from the following description taken in conjunction with the accompanying drawings which show by way of example some preferred embodiments of the invention.

DESCRIPTION OF PREFERRED EMBODIMENTS

Hereafter, the running water type washing machine of the present invention is described more particularly by way of its preferred embodiments with reference to the accompanying drawings.

Figure 1:
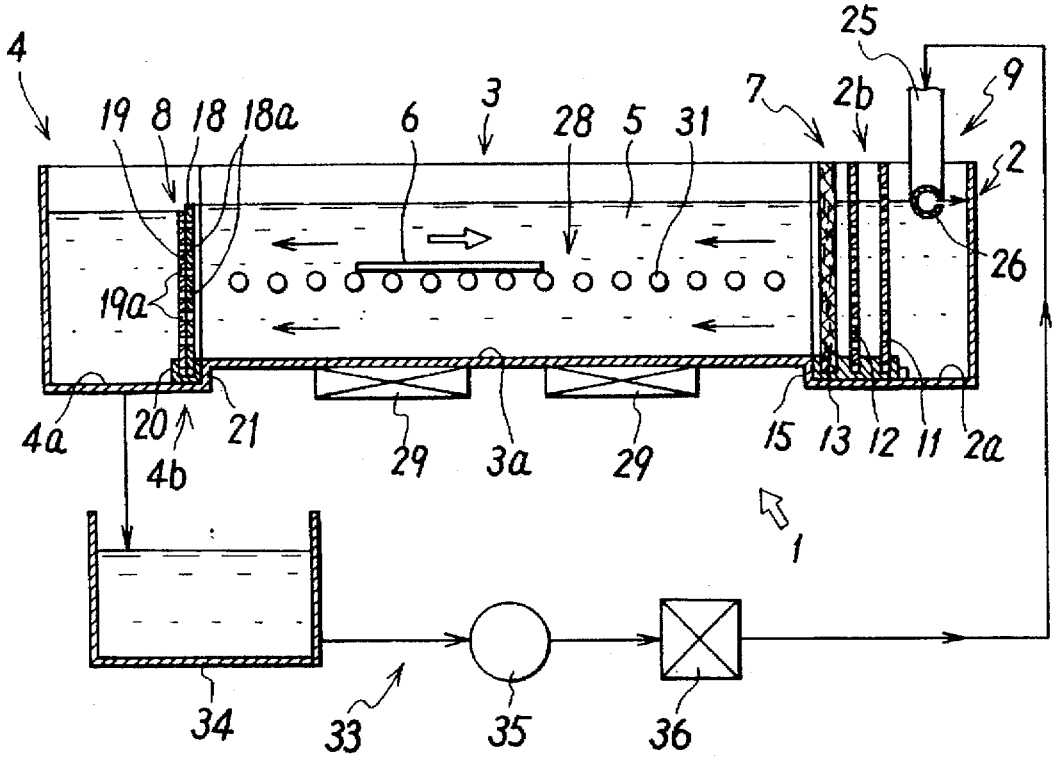
FIG. 1 is a longitudinal sectional view of an embodiment of the running water type washing machine according to the present invention.
Figure 2:
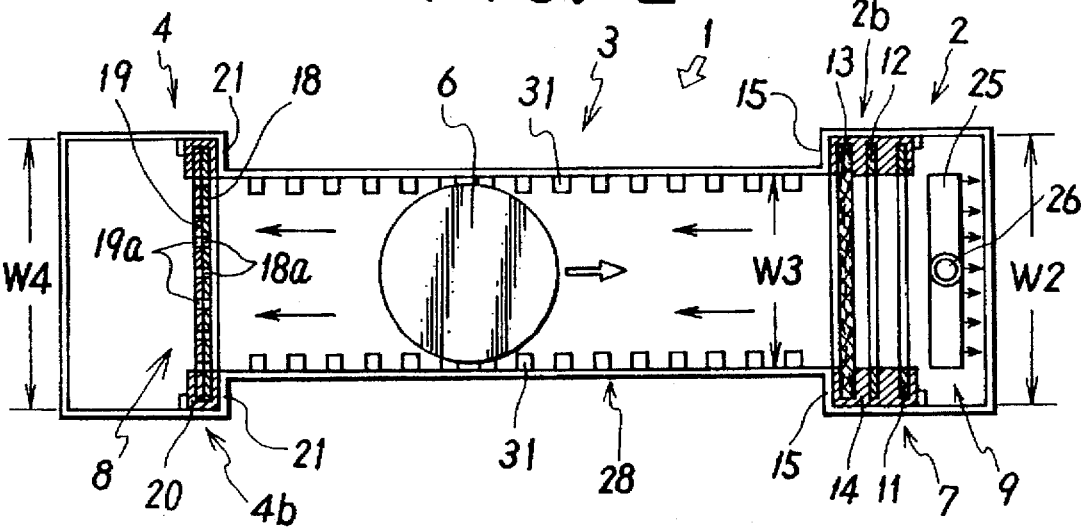
FIG. 2 is a partly sectioned plan view of the washing machine of FIG. 1.

Illustrated in FIGS. 1 and 2 is an embodiment of the running water type washing machine of the invention, including a washing vessel 1 of the so-called lateral flow type which is arranged to wash work in streams of a wash liquid flowing in a lateral direction through and along the washing vessel 1 at a moderate or low velocity (e.g., at about 10 mm to 20 mm/sec).

The washing vessel 1 includes a liquid feed section 2 which supplies a wash liquid such as pure water or ultra-pure water, a chemical treatment liquid or the like, a liquid discharge section 4 which discharges spent wash liquid, and a washing section 3 which is provided between the liquid feed section 2 and the liquid discharge section 4 and in which a work 6 is washed or rinsed in a submerged state under streams of a wash liquid 5 flowing from the liquid feed section 2 to the liquid discharge section 4 through the washing section 3.

The above-mentioned liquid feed section 2 and the liquid discharge section 4 of the washing vessel 1 are formed in broader widths W2 and W4, respectively, as compared with the intermediate washing section 3 which has a width W3. In addition, the liquid feed section 2 and the liquid discharge section 4 are formed in a greater depth than the intermediate washing section 3, with bottom levels **2*a* and 4*a* which are sunken or stepped down from a bottom level 3*a* of the intermediate washing section 3** of predetermined width and depth.

Provided in part of the liquid feed section 2 and the liquid discharge section 4 are flow regulator mount portions **2*b* and 4*b* for installation of flow regulator means 7 and 8**, respectively, which serve to regulate the flow of the wash liquid into uniform streams.

A liquid feeder means 9 is provided in the liquid feed section 2 at a position upstream of the flow regulator means 7 for supply of the wash liquid 5.

In order to ensure smooth flow of the wash liquid 5, the above-described washing vessel 1 is preferably formed of a metallic material like stainless steel or a synthetic resin material like vinyl chloride with smooth surfaces, aid more preferably constituted by one integral structure of synthetic resin molding. In case the whole structure of the washing vessel 1 is integrally formed by plastics molding, it becomes possible to rid the flow passage for the wash liquid 5, especially the flow passage in the washing section 3, of seams or protuberances which would invite deposition of contaminant substances detached from the work 6 or which would cause disturbances to the streams of the wash liquid 5, in addition to contribution to dust generation.

In case of forming the washing vessel 1 by synthetic resin molding, there may arise difficulties in integrating all of its parts into a single structure depending upon the size of the vessel 1 as a whole or structural shapes in details. In such a case, it is desirable to mold at least the washing section 3 into one structure which provides a seamless flow passage for the wash liquid, and to join separately molded liquid feed and discharge sections 2 and 4 to its upstream and downstream ends afterwards.

Figure 3:
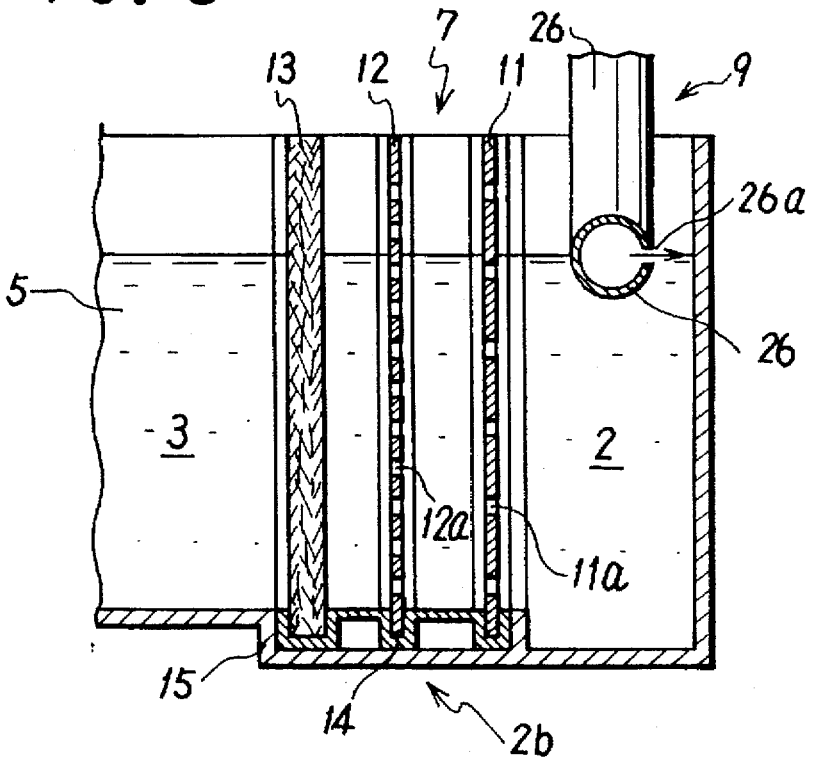
FIG. 3 is an enlarged fragmentary view of major components of the washing machine shown in FIG. 1.
Figure 4:
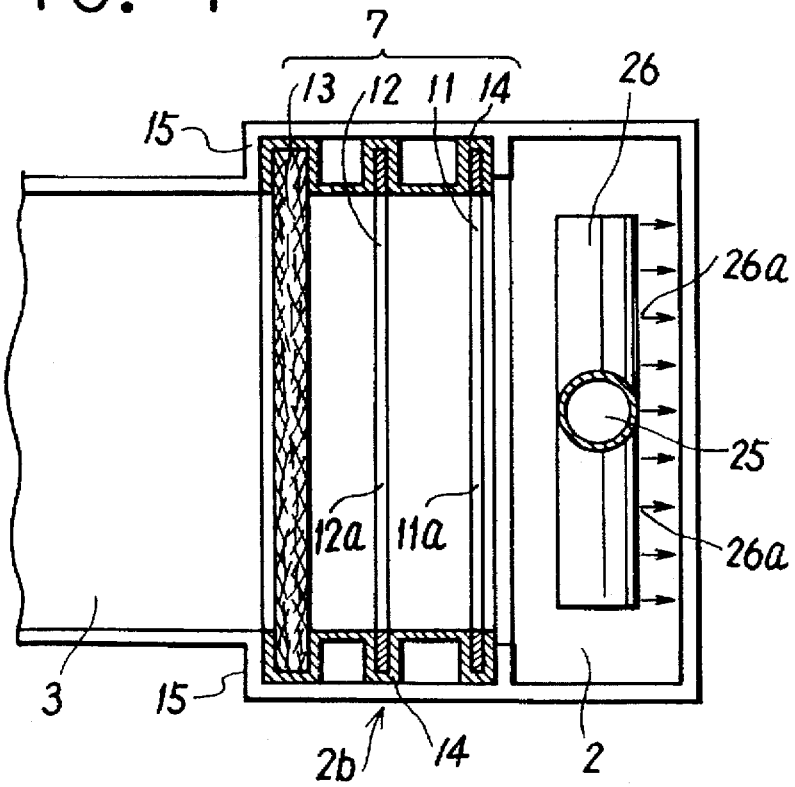
FIG. 4 is an enlarged fragmentary view of major components of the washing machine shown in FIG. 2.

As seen in FIGS. 3 and 4, the flow regulator means 7 on the side of the liquid feed section 2 is provided with a single or a plural number of perforated regulator plates. In the particular embodiment shown, the flow regulator means 7 is in the form of a flow regulator module unit having three regulator plates 11 to 13 detachably fitted in a holder frame 14 which is arranged to hold upper and lower ends of the respective regulator plates 11 to 13 in predetermined spaced positions in the flow direction. The holder frame 14 is removably mounted in position acrosss the flow passage in abutting engagement with a stepped portion 15 bordering on the washing section 3 in such a way that only perforated areas of the regulator plates 11 to 13 are disposed in the flow passage to the washing section 3.

All of the three regulator plates 11 to 13 of the flow regulator means 7 on the side of the liquid feed section may be of the same construction although regulator plates of different constructions are employed in the particular embodiment shown. Namely, in the embodiment shown, the first regulator plate 11 on the upstream side and the second regulator plate 12 in an intermediate position are constituted by perforated metal plates which are perforated with a multitude of water passage apertures 11*a* or 12*a*, while the regulator plate 13 on the downstream side is in the form of a fibrous plate of relatively coarse non-woven cloth of nylon, polyester or other synthetic fiber.

Figure 5:
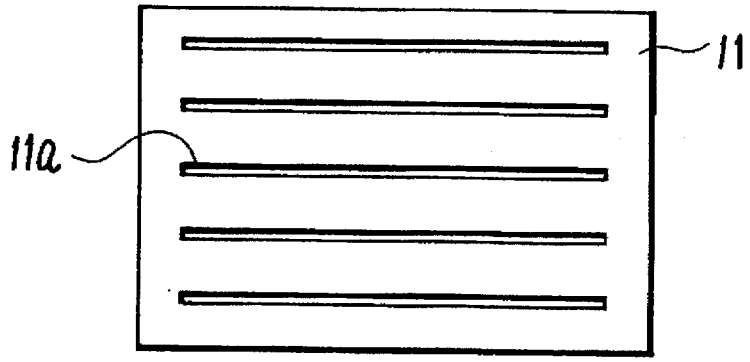
FIG. 5 is a schematic front view of a first flow regulator plate employed for a flow regulator means on the side of a liquid feed section of a washing vessel.
Figure 6:
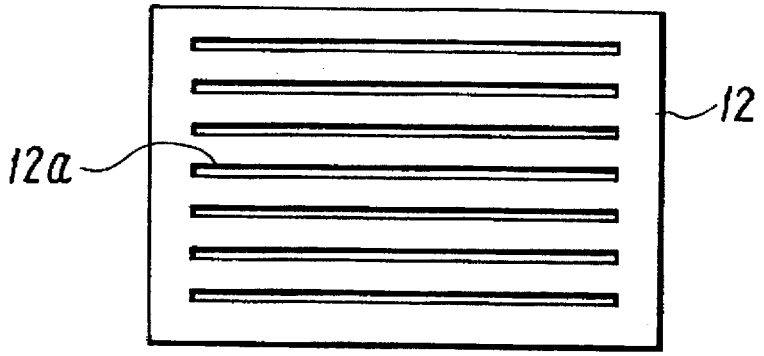
FIG. 6 is a schematic front view of a second flow regulator plate employed for the flow regulator means on the side of the liquid feed section.

As shown particularly in FIGS. 5 and 6, the first and second regulator plates 11 and 12 are perforated with water passage apertures 11*a* and 12*a* which are identical in shape and size, except that the water passage apertures 11*a* in the first regulator plate 11 are provided in a lower density or at greater intervals as compared with the water passage apertures 12*a* in the second regulator plate 12, for the purpose of holding the total water passage area of the first regulator plate 11 smaller than that of the second regulator plate 12.

The above-described water passage apertures 11*a* and 12*b* in the first and second regulator plates 11 and 12 may be formed in any other arbitrary shapes, more specifically, may be in the form of horizontally oriented slots as shown in the drawing or in the form of vertically oriented slots or apertures of circular or polygonal shapes. Alternatively, the regulator plates may have water passage apertures of different shapes in combination. In a case where slots are perforated to serve as the water passage apertures, the slots in one of the two regulator plates may be oriented in the horizontal direction while the slots in the other regulator plate are oriented in the vertical direction.

The fibrous plate for the third regulator plate 13 may be of any type as long as it is resistant to the wash liquid 5 and free from dust generation. For example, filter material generally used on air conditioners of buildings and factories can be suitably employed for this purpose. As the wash liquid 5 is filtered through the third regulator plate 13 of such fibrous material, which contains a multitude of interstices in complicatedly overlapped state between intertwined fine fibrous filaments in contrast to the straight water passages opened in the first and second regulator plates at predetermined intervals, uniform streams of the wash liquid 5 come out from the third regulator plate 13 almost free of diffusive movements. In this regard, it has been experimentally proved that the most favorable flow regulating effects can be obtained particularly when the third regulator plate 13 of fibrous material is combined with the above-described first and second regulator plates 11 and 12 which serve to suppress the flow velocity of the wash liquid to a sufficient degree before passage through the third flow regulator plate 13.

Thus, at the upstream flow regulator means 7, the wash liquid 5 from the liquid feeder means 9 is successively passed through the first and second flow regulator plates 11 and 12 thereby to moderate the flow velocity of the wash liquid while suppressing turbulent flows to form substantially uniform streams at the entire depths of the vessel before passage through the third regulator plate 13 of a fibrous plate, through which the wash liquid 5 is further regulated and sent forward toward the washing section 3 in the form of uniform laminar streams.

The holder frame 14 as well as unperforated peripheral areas of the first and second regulator plates 11 and 12 are positioned behind the stepped portion 15 between the liquid feed section 2 and the washing section 3, so that only perforated areas of the flow regulator plates 11 and 12 are disposed in the flow passage face to face with the washing section 3 to send forward the wash liquid 5 in uniform streams in a reassured manner, precluding the possibilities of turbulent flows as would otherwise be caused by the holder frame 14 and unperforated portions of the regulator plates 11 and 12.

Besides, since the flow regulator means 7 is in the form of a regulator module unit, it can be easily removed at the time of replacements of the respective regulator plates or when there arises a necessity for cleaning the washing vessel 1 or the regulator means 7. Naturally, this contributes to make the maintenance and service of the washing vessel extremely easy.

On the other hand, the downstream flow regulator means 8 on the side of the liquid discharge section is constituted by a couple of first and second regulator plates 18 and 19 in the form of perforated metallic plates which are perforated with a multitude of water passage apertures 18*a* or 19*a*. In this case, of the two flow regulator plates 18 and 19 which have the water passage apertures 18*a* and 19*b* of the same number, diameter and pitch, the first regulator plate 18 is fixedly positioned against and behind a stepped portion 21 between the liquid discharge section 4 and the washing section 3 of the vessel while the second regulator plate 19 is vertically slidably located behind the first regulator plate 18 in overlapped relation with the latter. Accordingly, by shifting the second regulator plate 19 up and down relative to the first regulator plate 18, the open flow area to the liquid discharge section 4 can be varied for adjustments of the flow speed of the wash liquid 5.

Figure 7:
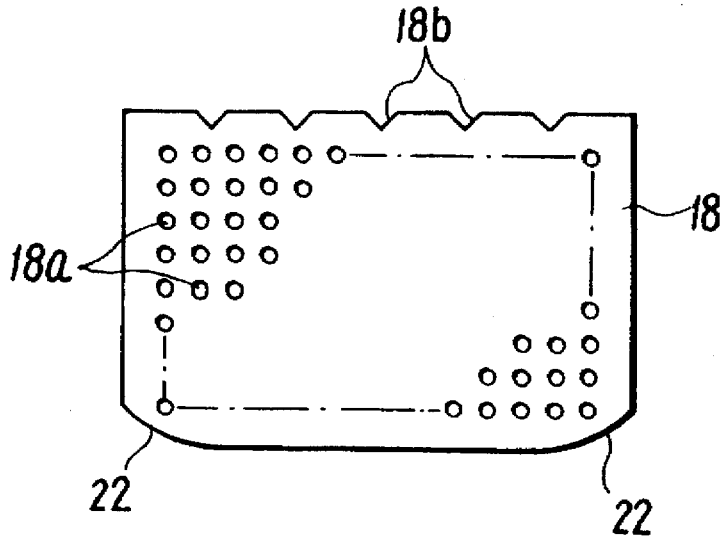
FIG. 7 is a schematic front view of a first flow regulator plate employed for a flow regulator means on the side of a liquid discharge section of the washing machine.

Of the above-mentioned two flow regulator plates 18 and 19, the first regulator plate 18 is formed in a greater height than the second regulator plate 19 in such a way as to cause overflowing to part of the wash liquid 5 at the tops of the two regulator plates. As shown in FIG. 7, the first regulator plate 18 is provided with a plural number of water flow V-notches 18*b* at predetermined intervals along its top edge, thereby stabilizing streams in upper layers of the overflowing wash liquid 5.

Similarly to the flow regulator means 7 on the side of the liquid feed section, the two flow regulator plates 18 and 19 are replaceably retained in a suitable holder frame 20, which is positioned against and behind the stepped portion 21 in such a way that only perforated areas of the regulator plates 18 and 19 are disposed in the flow passage face to face with the washing section 3. As a consequence, there is no possibility of the flowing wash liquid 5 being disturbed by the holder frame 20 or by unperforated areas of the regulator plates 18 and 19. It follows that, even on the side of the liquid discharge section, the washing vessel is freed from disturbances of the wash liquid 5 as would otherwise be caused by holder structures for the regulator plates 18 and 19, contributing to improve the effects of flow regulation all the more.

Preferably, the regulator plates 18 and 19 of the flow regulator means 8 on the side of the liquid discharge section are provided with notches 22 at the opposite lower corner portions thereby to accelerate the flow speed in lower layers which tend to lag behind upper and middle layers and at the same time to let contaminant substances detached from the work go out through the notched areas 22, particularly the contaminant substances of relatively large specific gravity.

The liquid feeder means 9 of the liquid feed section 2 includes a spout pipe 26 which is horizontally connected to the lower end of a conduit 25 in communication with a wash liquid source which is not shown. The spout pipe 26 is provided with a plural number of spout holes 26*a* on a lateral side away from the above-described flow regulator means 7 to spout the wash liquid 5 therethrough. The spout pipe 26 is mounted at such a height that the spout holes 26*a* are located substantially at the surface level of the wash liquid 5.

In this regard, however, it is to be understood that the liquid feeder means 9 is not restricted to the particular arrangements shown.

Further, the washing section 3 of the vessel 1 is preferably provided with a transfer means 28 for transferring the work 6 under the wash liquid 5 from a downstream end to an upstream end in a counter-flow direction, and at least one ultrasonic radiation means 29 to enhance the washing effects by application of ultrasound energy.

In the particular embodiment shown, the transfer means 28 is constituted by a roller conveyer consisting of a plural number of rollers which are rotatably supported at predetermined intervals on and along the opposite side walls of the washing section 3 and adapted to be driven from an electric motor, not shown, to transfer the work 6 in a horizontally supported state in the counter-flow direction. However, the transfer means 28 is not restricted to the particular example shown, and may be arranged to transfer the work 6 in a vertical position on a support moving parallel with the streams of the wash liquid 5.

By the use of the transfer means 28 which moves the work 6 in a counter-flow direction under streams of the wash liquid 5, the flow velocity relative to the work 6 can be accelerated without increasing the actual flow velocity of the wash liquid, and as a result it becomes possible to wash the work efficiently with a smaller amount of wash liquid. In addition, the transfer means 28 contributes to reductions of wash liquid consumption, which have a great significance especially in those cases where expensive pure water or ultra pure water is used as a wash liquid 5.

For the purpose of enhancing economical merits all the more through reductions of consumption of the expensive wash liquid, used wash liquid may be recirculated for reuse, if desired, through a recycling circuit 33 which is provided between the liquid feed section 2 and the liquid discharge section 4. Desirably, the recycling circuit 33 includes a reservoir tank 34 for collecting effluent wash liquid 5 from the discharge section 4, a pump 35 for sending the wash liquid 5 back to the liquid feed section 2, and a filter 36 for cleaning the recycling wash liquid 5.

In the washing machine of the above-described arrangements, the flow of the wash liquid 5, which is fed to the liquid feed section 2 through the spout pipe 26 of the liquid feeder means 26, is regulated into uniform streams as it is successively passed through the first to third regulator plates 11 to 13 of the upstream flow regulator means 7 on its way to the washing section 3. On the other hand, at the downstream regulator means 7, the wash liquid is passed through the regulator plates 18 and 19 and discharged to the outside along with part of the wash liquid 5 flowing into the discharge section 4 over the top of these regulator plates. In case the washing machine includes above-described recycling circuit 33, the effluent wash liquid 5 is cleaned by filtration prior to recirculation to the liquid feed section 2.

In operation, the work 6 to be washed is put on the roller conveyer 31 at the downstream end of the washing section 3 by a loading means, which is not shown, and transferred toward the upstream end in the counter-flow direction while undergoing washing by the wash liquid 5. The washed work is picked out at the upstream end by an unloading means which is also not shown.

Contaminant substances once detached from the work 6 are carried away from the latter, entrained on the streams of the wash liquid 5, and discharged from the liquid discharge section 4 without being allowed to redeposit on the work 6.

Figure 8:
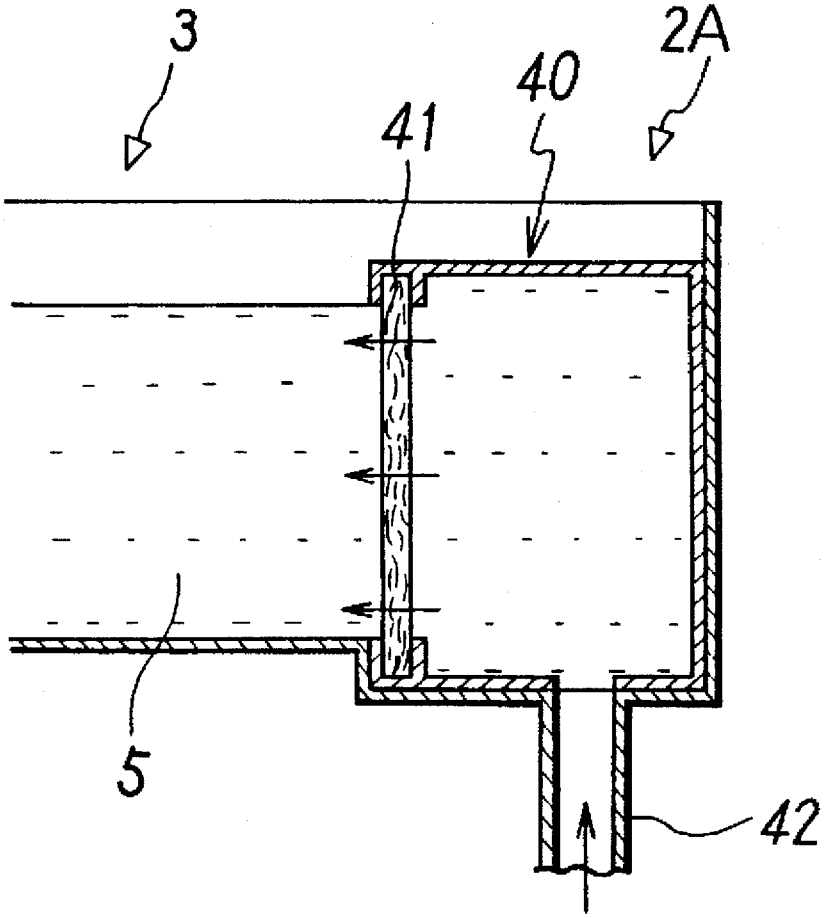
FIG. 8 is a sectional view of major components of a different embodiment of the present invention.

Shown in FIG. 8 is a modification of the washing machine, which employs a liquid feed section of different arrangements. More specifically, this modified embodiment has a liquid feed section 2A of closed construction to send the wash liquid 5 to the washing section 3 under pressure through a flow regulator plate 41 which is located against and behind stepped walls bordering on the washing section 3.

In this case, in order to increase the pressure of the wash liquid 5, the above-mentioned regulator plate 41 is preferred to be of a fibrous plate of non-woven fabric which is finer in mesh size than the regulator plate 13 of the first embodiment.

Thus, by the use of the liquid feed section 2A of closed construction which is arranged to push the wash liquid 5 forward under pressure through the regulator plate 41 as described above, it becomes possible to equalize the flow velocities of upper and lower layers of the wash liquid 5 and to form uniform streams at all depths of the washing section 3 in a simple and facilitated manner. In addition, this can be achieved simply by feeding the wash liquid to the liquid feed section 2A through a feed pipe which is opened through a bottom or side wall of the liquid feed section 2A without using any liquid feed means of complicate construction.

Although one regulator plate 41 alone is provided in the modification shown, of course there may be employed a flow regulator means consisting of two or more regulator plates. A combination of a regulator plate of fibrous material and a regulator plate of perforated metal sheet may also be used if desired.

Further, from the standpoint of facilitating maintenance and service, it is advantageous to employ a box-like liquid feed/regulation module unit 40 which is provided with the regulator plate 41 on the front side and dimensioned to fit removably in the liquid feed section 2A as shown in the drawing.

As will be understood from the foregoing description, according to the running water type washing machine of the present invention, at least the liquid feed section is formed in a greater width than the ensuing washing section in the transverse direction and at the same time in a greater depth to have a bottom surface sunken from that of the washing section through a stepped portion, and a holder frame for flow regulator plates of the upstream flow regulator means is mounted in position in the liquid feed section by abutting engagement with the stepped portion bordering on the washing section in such a way as to hold only perforated portions of the regulator plates in the flow passage to the washing section, thereby regulating the wash liquid into uniform streams free of disturbances as would otherwise be caused by a regulator plate holder structure or unperforated portions of the flow regulator plates.

Besides, the upstream flow regulator means on the side of the liquid feed section can be provided in the form of a regulator module unit having a plural number of regulator plates detachably fitted in a holder frame for the purpose of facilitating the maintenance and service of the flow regulator means, including mounting and dismantling as well as replacements and cleaning of the respective regulator plates.

Further, thanks to the multi-stage flow regulation through a plural number of flow regulator plates, the wash liquid can be regulated into uniform laminar streams in an assured manner.

What is claimed is:

1. A running water type washing machine, comprising:

a washing vessel defining for a wash liquid a flow passage having in series a liquid feed section for supplying said wash liquid, an intermediate washing section for washing work in a submerged state under streams of said wash liquid from the liquid feed section, and a liquid discharge section for discharging used wash liquid from said washing section, at least either one of said liquid feed section and liquid discharge section being formed in a greater width than said intermediate washing section in the transverse direction thereof and at the same time formed in a greater depth to have a bottom level sunken from that of said washing section through a stepped portion;

an upstream flow regulator means located on the side of said liquid feed section, and having at least one perforated flow regulator plate mounted in position by abutting engagement with said stepped portion bordering on said washing section in such a way as to hold only perforated portions of said flow regulator plate in the flow passage to said washing section; and a downstream flow regulator means located on the side of the liquid discharge section and having at least one perforated flow regulator plate.

2. A running water type washing machine as defined in claim 1, wherein at least said liquid discharge section of said washing vessel is formed in a greater width than said washing section in the transverse direction thereof and at the same time formed in a greater depth to have a bottom level sunken from that of said washing section through a stepped portion; and said perforated flow regulator plate of said downstream flow regulator means is mounted in position by abutting engagement with said stepped portion bordering on said washing section in such a way as to hold only perforated portions of said flow regulator plate in the flow passage from said washing section.

3. A running water type washing machine as defined in claim 1 or 2, wherein at least said washing section of said washing vessel is constituted by a single integral structure formed by synthetic resin molding and defining a seamless flow passage therethrough.

4. A running water type washing machine as defined in claim 1 or 2, wherein said upstream flow regulator means on the side of said liquid feed is in the form of a flow regulator module unit having a plural number of flow regulator plates detachably fitted in a holder frame in predetermined spaced relations with each other, said flow regulator unit being removably fitted in and across the flow passage of said liquid feed section against said stepped portion.

5. A running water type washing machine as defined in claim 1 or 2, wherein said downstream flow regulator means on the side of said liquid discharge section of said washing vessel is provided with a couple of perforated flow regulator plates in a relatively movably overlapped state for adjustments of water passing open areas.

6. A running water type washing machine as defined in claim 1 or 2, wherein said washing vessel is provided with a work transfer means for transferring work from a downstream end to an upstream end of said washing section in a counter-flow direction and in a submerged state under streams of said wash liquid.

7. A running water type washing machine as defined in claim 1 or 2, wherein said washing vessel further comprises a wash liquid recycling circuit for recirculation of used wash liquid from said liquid discharge section to said liquid feed section, said recycling circuit including a reservoir tank for collecting used wash liquid from said liquid discharge section, a pump for sending under pressure the collected wash liquid in said reservoir tank to said liquid feed section, and a filter means for cleaning the recycling wash liquid.

8. A running water type washing machine as defined in claim 1 or 2, wherein said washing section is provided with an ultrasonic radiation means for application of ultrasound energy.

9. A running water type washing machine, comprising:

a washing vessel defining for a wash liquid a flow passage having in series a liquid feed section for supplying the wash liquid, an intermediate washing section for washing work in a submerged state under streams of said wash liquid from said liquid feed section, and a liquid discharge section for discharging used wash liquid from said washing section, both of said liquid feed section and liquid discharge section being formed in a greater width than said washing section in the transverse direction thereof and at the same time formed in a greater depth to have a bottom level sunken from that of said washing section through stepped portions;

an upstream flow regulator means located on the side of said liquid feed section, and being provided in the form of a flow regulator module unit having a plural number of flow regulator plates detachably fitted in a holder frame in predetermined spaced relations with each other, and removably fitted in and across the flow passage of said liquid feed section in abutting engagement with said stepped portion bordering on said washing section; and a downstream flow regulator means located on the side of said liquid discharge section and having a couple of perforated flow regulator plates in a relatively movably overlapped state for adjustments of water passing open areas, said downstream flow regulator means being mounted in position by abutting engagement with said stepped portion bordering on said washing section in such a way as to hold only perforated portions of said regulator plates in the flow passage from said washing section.

10. A running water type washing machine as defined in claim 9, wherein at least said washing section of said washing vessel is constituted by a single integral structure molded by synthetic resin molding and defining a seamless flow passage therethrough.

11. A running water type washing machine as defined in claim 9, wherein said washing vessel is provided with a work transfer means for transferring work from a downstream end to an upstream end of said washing section in a counter-flow direction and in a submerged state under streams of said wash liquid.

12. A running water type washing machine as defined in claim 9 or 11, wherein said washing vessel further comprises a wash liquid recycling circuit for recirculation of used wash liquid from said liquid discharge section to said liquid feed section, said recycling circuit including a reservoir tank for collecting used wash liquid from said liquid discharge section, a pump for sending under pressure the collected wash liquid in said reservoir tank to said liquid feed section, and a filter means for cleaning the recycling wash liquid.

13. A running water type washing machine as defined in claim 9 or 11, wherein said washing section is provided with an ultrasonic radiation means for application of ultrasound energy.

14. A running water type washing machine as defined in claim 1 or 9, wherein said liquid feed section is arranged in closed construction to send forward said wash liquid under pressure to said washing section through said upstream flow regulator means mounted in position against said stepped portion bordering on said washing section.

* * * * *